US009893441B2

(12) United States Patent
Moriyasu et al.

(10) Patent No.: US 9,893,441 B2
(45) Date of Patent: Feb. 13, 2018

(54) CARD EDGE CONNECTOR AND METHOD FOR MANUFACTURING SAME

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Masanori Moriyasu, Mie (JP); Masaaki Tabata, Mie (JP); Tetsuya Shinozaki, Mie (JP)

(73) Assignees: AUTONETWORKS TECHNOLOGIES, LTD., Yokkaichi, Mie (JP); SUMITOMO WIRING SYSTEMS, LTD., Yokkaichi, Mie (JP); SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 15/501,899

(22) PCT Filed: Aug. 3, 2015

(86) PCT No.: PCT/JP2015/071948

§ 371 (c)(1),
(2) Date: Feb. 6, 2017

(87) PCT Pub. No.: WO2016/021548

PCT Pub. Date: Feb. 11, 2016

(65) Prior Publication Data

US 2017/0244183 A1 Aug. 24, 2017

(30) Foreign Application Priority Data

Aug. 8, 2014 (JP) ..... 2014-162356
Dec. 19, 2014 (JP) ..... 2014-257110

(51) Int. Cl.
*H01R 24/00* (2011.01)
*H01R 12/70* (2011.01)
(Continued)

(52) U.S. Cl.
CPC ..... *H01R 12/7005* (2013.01); *H01R 12/721* (2013.01); *H01R 13/113* (2013.01); *H01R 13/50* (2013.01)

(58) Field of Classification Search
CPC ..... H01R 13/64; H01R 13/42; H01R 12/75; H01R 12/721; H01R 12/72
(Continued)

(56) References Cited

U.S. PATENT DOCUMENTS 4,934,961 A * 6/1990 Piorunneck ..... H01R 43/16 439/59
9,281,592 B2 * 3/2016 Nagamine ..... H01R 12/721
(Continued)

FOREIGN PATENT DOCUMENTS

JP 49-139552 12/1974
JP 58-173188 11/1983
(Continued)

OTHER PUBLICATIONS

International Search Report dated Oct. 13, 2015.

*Primary Examiner* — Abdullah Riyami
*Assistant Examiner* — Nelson R Burgos-Guntin
(74) *Attorney, Agent, or Firm* — Gerald E. Hespos; Michael J. Porco; Matthew T. Hespos

(57) ABSTRACT

It is aimed to prevent a reduction of contact reliability. A card edge connector (A) includes a first housing (10) formed with a board accommodation space (16) open forward, terminal fittings (17) provided in the first housing (10) and formed with resilient contact portions (18) projecting toward the board accommodation space (16), a second housing (20)
(Continued)

including a circuit board (23) to be inserted into the board accommodation space (16) from front of the first housing (10), and guide slopes (36) made of synthetic resin, provided to cover a leading edge of the circuit board (23) in an inserting direction into the board accommodation space (16) and inclined with respect to the inserting direction into the board accommodation space (16).

11 Claims, 10 Drawing Sheets

(51) Int. Cl.
*H01R 12/72* (2011.01)
*H01R 13/11* (2006.01)
*H01R 13/50* (2006.01)

(58) Field of Classification Search
USPC ..... 439/630
See application file for complete search history.

(56) References Cited

U.S. PATENT DOCUMENTS 9,413,090 B2 * 8/2016 Nagamine ..... H01R 12/721
9,461,385 B2 * 10/2016 Moriyasu ..... H01R 12/721
2009/0191760 A1 * 7/2009 Hori ..... H01R 13/5205 439/629
2009/0191764 A1 * 7/2009 Hori ..... H01R 12/79 439/637
2011/0021080 A1 * 1/2011 Kamiya ..... H01R 12/778 439/637
2013/0217264 A1 * 8/2013 Endo ..... H01R 13/40 439/630
2013/0267108 A1 * 10/2013 Nagamine ..... H01R 13/52 439/271
2013/0288541 A1 * 10/2013 Nagamine ..... H01R 13/52 439/692
2013/0316586 A1 * 11/2013 Nagamine ..... H01R 12/721 439/630
2013/0323955 A1 * 12/2013 Nishio ..... H01R 12/732 439/325
2014/0294349 A1 * 10/2014 Nishio ..... H01R 13/5213 385/77
2015/0031248 A1 * 1/2015 Nishio ..... H01R 13/533 439/691
2015/0340784 A1 * 11/2015 Moriyasu ..... H01R 12/721 439/630
2015/0340786 A1 * 11/2015 Nishio ..... H01R 12/714 439/630
2015/0349469 A1 * 12/2015 Nishio ..... H01R 12/714 439/620.22
2015/0380852 A1 * 12/2015 Endo ..... H01R 12/53 439/744
2015/0380873 A1 * 12/2015 Endo ..... H01R 12/87 439/620.22

FOREIGN PATENT DOCUMENTS

JP 7-231153 8/1995
JP 9-172238 6/1997
JP 10-199637 7/1998
JP 2001-67459 * 3/2001 ..... H01R 24/00
JP 2008-91047 4/2008
JP 2014-3007 1/2014

* cited by examiner

CARD EDGE CONNECTOR AND METHOD FOR MANUFACTURING SAME

BACKGROUND

1. Field of the Invention

The present invention relates to a card edge connector and a method for manufacturing the same.

2. Description of the Related Art

Japanese Unexamined Patent Publication No. 2008-091047 discloses a card edge connector with a housing including a board accommodation space and a plurality of terminal fittings accommodated in the housing and arranged to face each other across the board accommodation space. This card edge connector comes into contact with a circuit board inserted into the board accommodation space while resilient pieces provided in the terminal fittings are resiliently deformed. A predetermined contact pressure is ensured between the terminal fittings and the circuit board by a resilient contact action of the resilient pieces. Further, dimensional tolerances of the housing, the terminal fittings and the circuit board are absorbed by resilient deformation of the resilient pieces. Thus, a structure configured to come into contact with the circuit board while the resilient pieces are resiliently deformed is necessary to ensure contact reliability between the terminal fittings and the circuit board.

However, providing the structure that contacts the circuit board while the resilient pieces are resiliently deformed means that corner edge parts on a leading end in an inserting direction of the circuit board butt against the resilient pieces and are strongly abraded against the resilient pieces in the process of inserting the circuit board into the board accommodation space. Such butting and abrasion may cause improper deformation of the resilient pieces, plating peeling on contact portions of the resilient pieces, jamming of shaving from a part of the corner edge part of the circuit board between the resilient pieces and the circuit board and, eventually, a contact failure.

The present invention was completed based on the above situation and aims to prevent a reduction of contact reliability.

SUMMARY

A first aspect of the invention is directed to a card edge connector with a first housing formed with a board accommodation space open forward. At least one terminal fitting is provided in the first housing and is formed with a resilient contact portion projecting toward the board accommodation space. The card edge connector further has a second housing including a circuit board to be inserted into the board accommodation space from the front of the first housing. A guide slope made of synthetic resin covers a leading edge of the circuit board in an inserting direction into the board accommodation space and is inclined with respect to the inserting direction into the board accommodation space.

An event that causes a reduction of contact reliability may occur on the resilient contact portion and the circuit board if a corner edge part on a leading end in the inserting direction of the circuit board comes into contact with the resilient contact portion in the process of inserting the circuit board into the board accommodation space. However, the resilient contact portion of the card edge connector of the invention only slides in contact with the guide slope made of synthetic resin and inclined with respect to the inserting direction and does not contact the leading edge in the inserting direction of the circuit board. Thus, there is no possibility of reducing contact reliability.

A second aspect of the invention is directed to a method for manufacturing a card edge connector with a first housing formed that has a board accommodation space open forward. At least one terminal fitting is provided in the first housing and is formed with a resilient contact portion projecting toward the board accommodation space. The card edge connector further has a second housing including a circuit board to be inserted into the board accommodation space from the front of the first housing. A board holding member made of synthetic resin surrounds an area of the circuit board except a leading end part in the inserting direction. A guide member made of synthetic resin is configured separately from the board holding member and covers a leading edge of the board holding member in the inserting direction into the board accommodation space on the leading end part in the inserting direction of the board holding member and includes a guide slope inclined with respect to the inserting direction into the board accommodation space. The method is characterized in that the board holding member is molded to embed a part of the guide member except a leading end part in the inserting direction therein after the guide member is attached to a leading end part of the circuit board.

Further, in the method for manufacturing a card edge connector according to the invention, the board holding member is molded with a part of the guide member embedded after the guide member is attached to the leading end part of the circuit board. Thus, the guide member can be held reliably without being detached from the circuit board.

The second housing may include a board holding member made of synthetic resin and configured to surround an area of the circuit board except a leading end part in the inserting direction, and the guide slope may be formed on a component separate from the board holding member. According to this configuration, the material of the guide slope can be selected regardless of the board holding member. The guide slope may be formed of a synthetic resin material containing no glass fiber. According to this configuration, a coating of the resilient contact portion can be prevented from being scraped.

The guide slope may be formed on a guide member, and the guide member may be formed with a pair of covering portions configured to sandwich a leading edge part in the inserting direction of the circuit board in a plate thickness direction. According to this configuration, the covering portions sandwich the leading edge part in the inserting direction of the circuit board in the plate thickness direction. Thus, there is no possibility of a displacement of the guide slope in the plate thickness direction with respect to the circuit board.

The covering portion may be formed with a guiding slope inclined with respect to the inserting direction of the circuit board. A step is formed between the covering portion and the circuit board. However, since the covering portion is formed with the guiding slope, the resilient contact portion neither strongly butts against nor is abraded against the covering portion in the process of pulling out the circuit board from the board accommodation space.

A leading end part in the inserting direction of the circuit board may be provided with a guide member including the guide slope, whereas the second housing may include a board holding member made of synthetic resin and configured to surround an area of the circuit board except a leading end part in the inserting direction, and a part of the guide member except a leading end part in the inserting direction may be embedded in the board holding member. According to this configuration, the guide member is less likely to be detached from the circuit board, thereby contributing to an increase of a guide member holding force.

DETAILED DESCRIPTION

Figure 1:
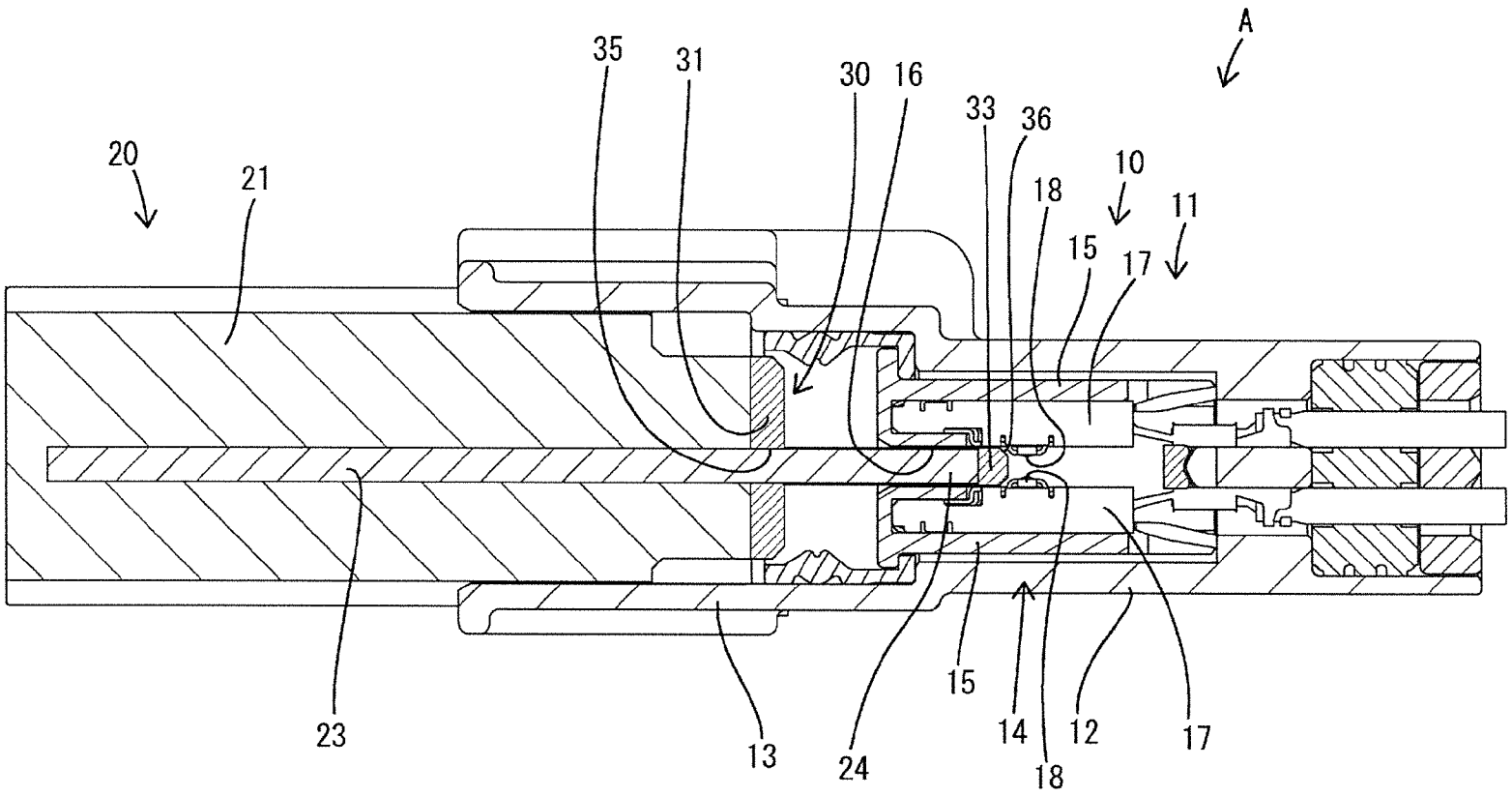
FIG. 1 is a section showing the process of inserting a circuit board into a board accommodation space in a card edge connector of a first embodiment.
Figure 2:
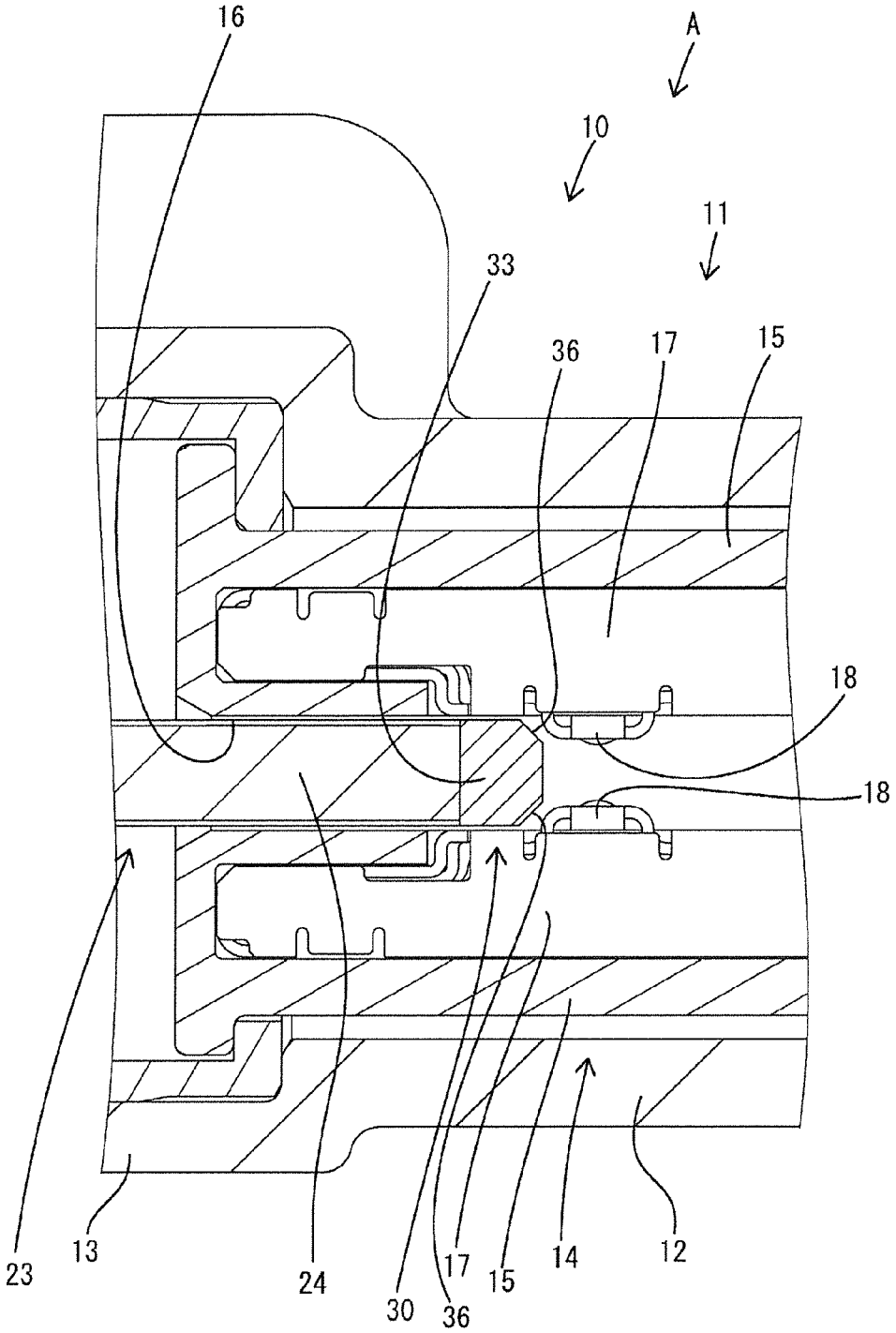
FIG. 2 is a partial enlarged section of FIG. 1.
Figure 3:
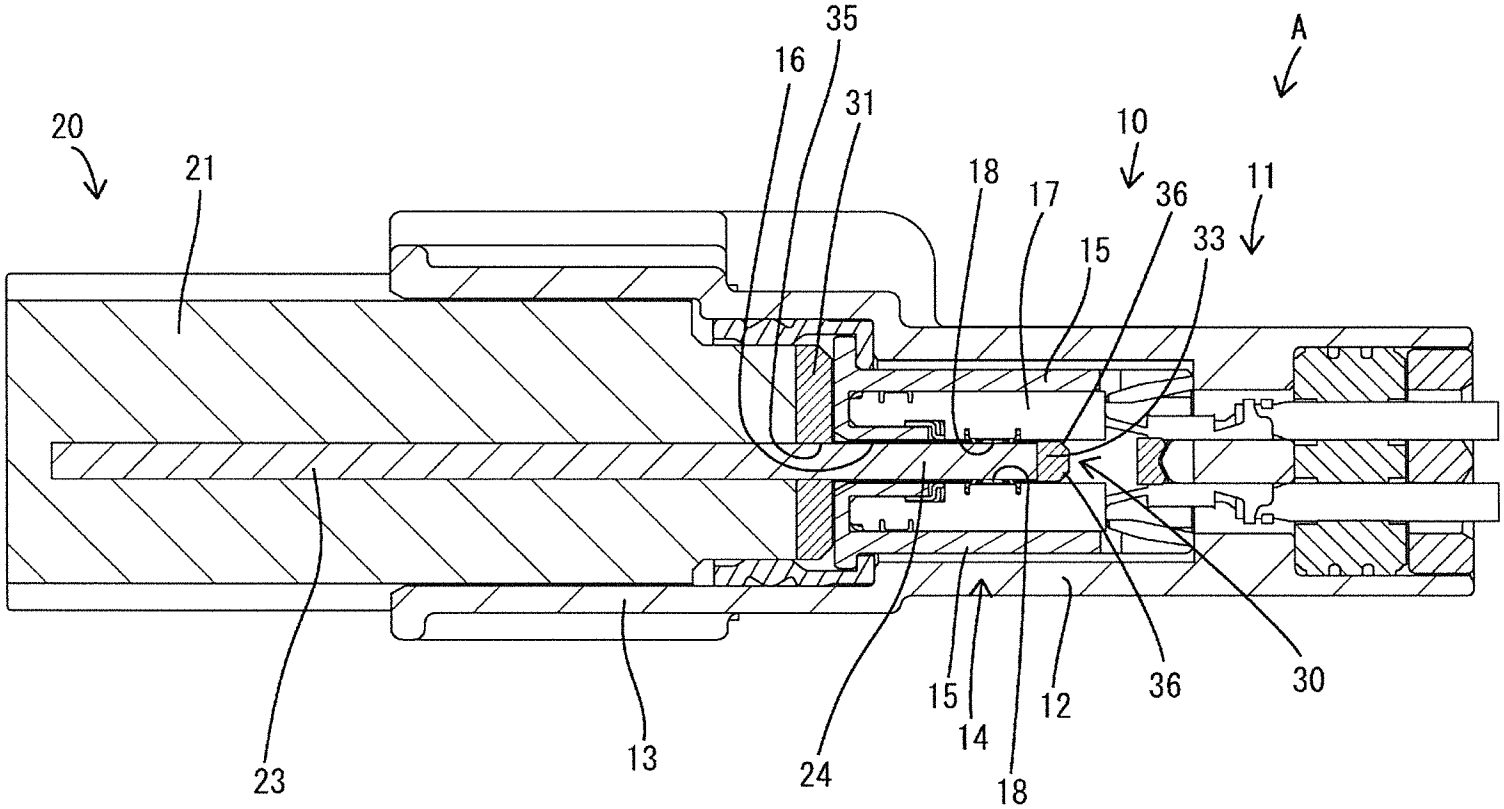
FIG. 3 is a section showing a state where the circuit board is inserted in the board accommodation space.
Figure 4:
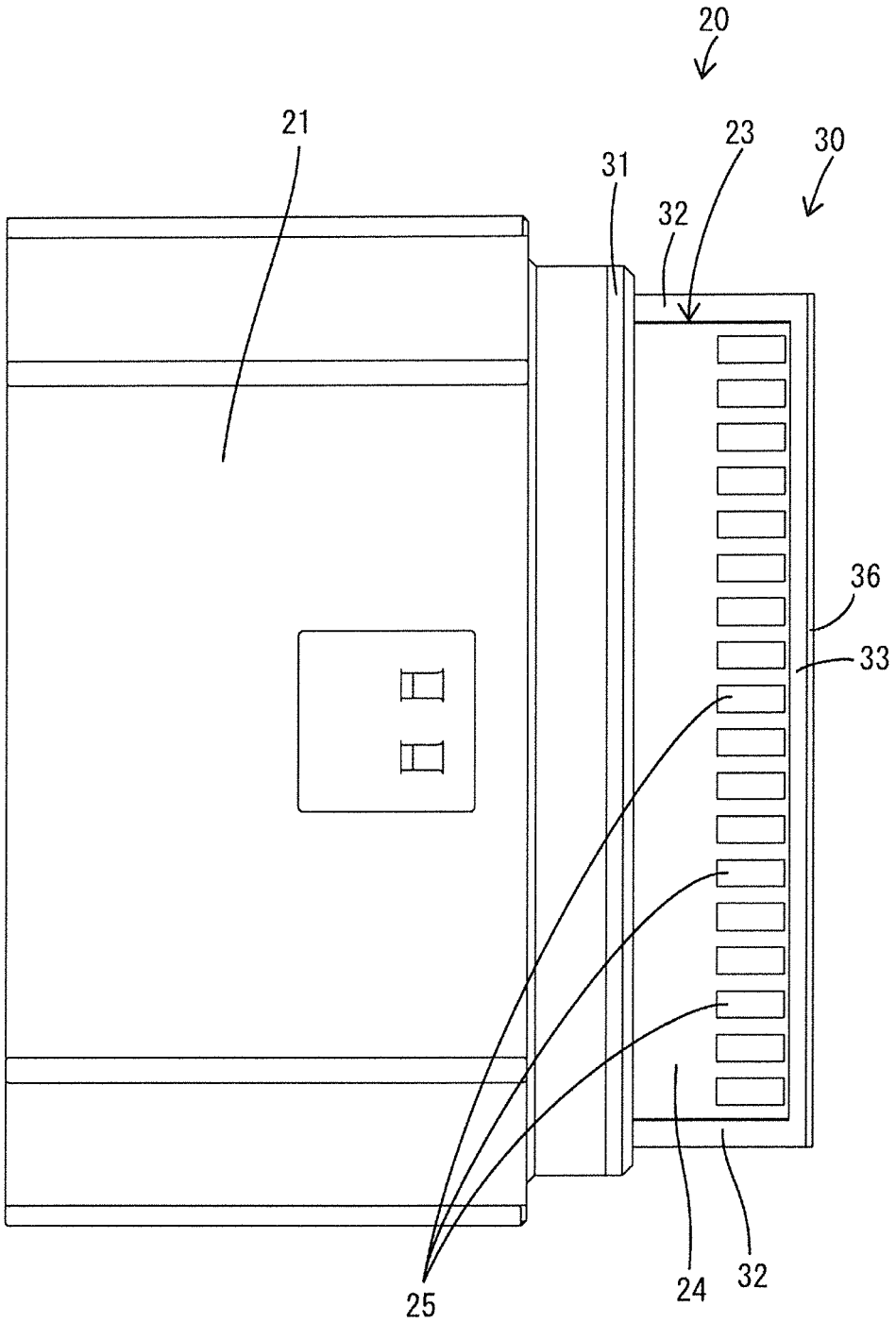
FIG. 4 is a plan view of a second housing.
Figure 5:
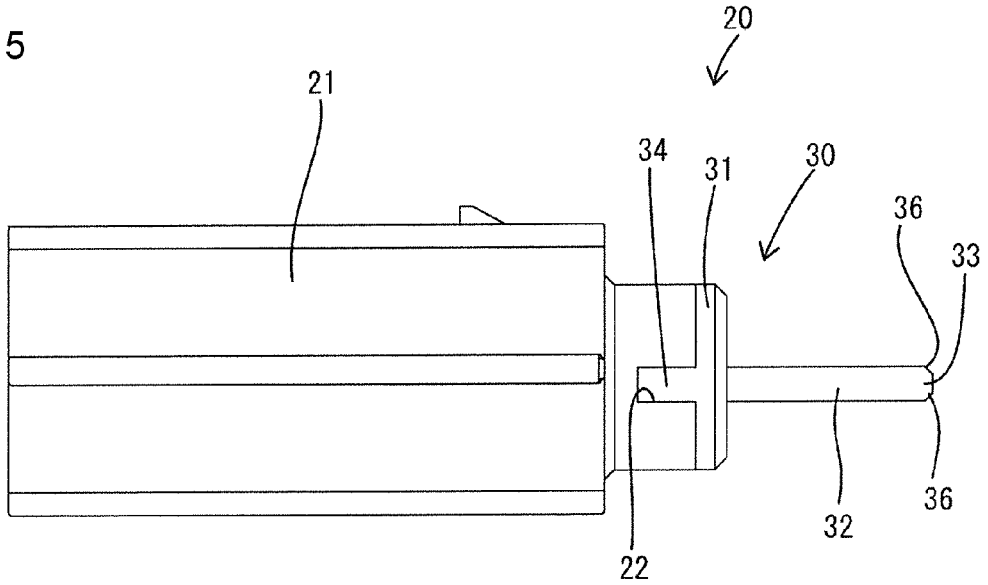
FIG. 5 is a side view of the second housing.
Figure 6:
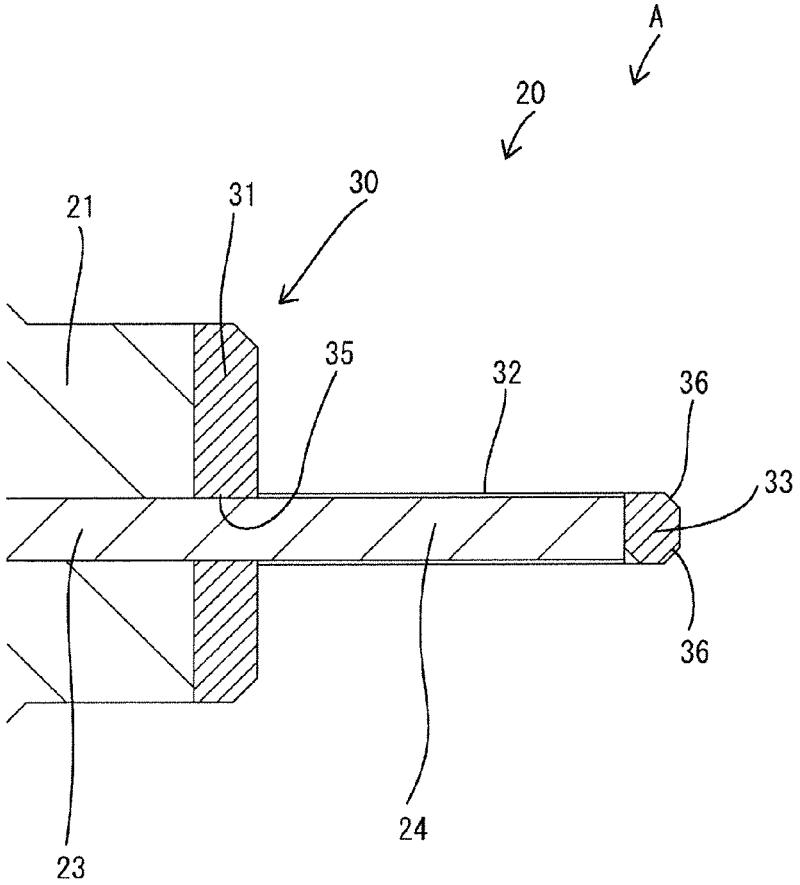
FIG. 6 is a partial enlarged section of the second housing.

Hereinafter, a first embodiment of the invention is described with reference to FIGS. 1 to 6. A card edge connector A of this first embodiment includes a first housing 10 and a second housing 20.

<First Housing 10>

The first housing 10 is configured by mounting an inner housing 14 made of synthetic resin into an outer housing 11 made of synthetic resin and has a substantially rectangular front shape long in a lateral direction (width direction) as a whole. The outer housing 11 includes a housing accommodating portion 12 in the form of a rectangular tube open forward (leftward in FIGS. 1 and 2) and a tubular fitting portion 13 located forward of the outer peripheral edge of the front end of the housing accommodating portion 12.

The inner housing 14 includes a pair of vertically symmetrical facing portions 15. A plurality of terminal fittings 17 long and narrow in a front-back direction are accommodated side by side in the width direction in the upper facing portion 15. The terminal fittings 17 are formed with resilient contact portions 18 projecting from the lower surface (surface facing a board accommodation space 16 to be described later) of the upper facing portion 15. A plurality of terminal fittings 17 long and narrow in the front-back direction are accommodated side by side in the width direction also in the lower facing portion 15. The terminal fittings 17 are formed with resilient contact portions 18 projecting from the upper surface (surface facing the board accommodation space 16) of the lower facing portion 15. The inner housing 14 is accommodated into the housing accommodating portion 12 of the outer housing 11 from front and fixed. A space between the pair of upper and lower facing portions 15 serves as the board accommodation space 16 into which a circuit board 23 of the second housing 20 is to be inserted. The board accommodation space 16 is in the form of a slit long in the width direction and open forward. Since the lower surface of the upper facing portion 15 and the upper surface of the lower facing portion 15 are directly facing the board accommodation space 16, the resilient contact portions 18 of the terminal fittings 17 accommodated in the upper facing portion 15 and the resilient contact portions 18 of the terminal fittings 17 accommodated in the lower facing portion 15 project into the board accommodation space 16.

<Second Housing 20>

The second housing 20 includes a board holding member 21, the circuit board 23 and a guide member 30. A leading edge part of the circuit board 23 in an inserting direction into the board accommodation space 16 serves as a connecting edge portion 24. A plurality of board contact portions 25 capable of contacting the resilient contact portions 18 are arranged in the lateral direction (width direction) on both sides (both upper and lower surfaces) of the connecting edge portion 24. The circuit board 23 is integrated with the board holding member 21 made of synthetic resin (e.g. epoxy resin) by insert molding. Specifically, most of the area of the circuit board 23 except the connecting edge portion 24 is surrounded by the board holding member 21 and the connecting edge portion 24 projects like a rib from the front surface (right surface in FIGS. 1, 3 to 5) of the board holding member 21 facing the first housing 10.

The guide member 30 is a component separate from the board holding member 21. The guide member 30 is made of a resin material different from the board holding member 21. A synthetic resin material containing no glass fiber and having a lower rigidity (i.e. higher flexibility) than the board holding member 21 such as PBT can be used as the material of the guide member 30, for example, to improve attachability. The guide member 30 is an integral assembly of a wall-like portion 31, a pair of bilaterally symmetrical side frame portions 32, a front frame portion 33 and a pair of bilaterally symmetrical protrusions 34. The wall-like portion 31 has a substantially rectangular shape long and narrow in the lateral direction and includes a slit-like through groove 35. The pair of side frame portions 32 extend forward from both left and right end parts on the front surface of the wall-like portion 31. The front frame portion 33 couples the front ends (extending ends) of the both left and right side frame portions 32 and is long and narrow in the lateral direction. The protrusions 34 are cantilevered backward from both left and right end parts of the wall-like portion 31.

The guide member 30 is attached to the board holding member 21 from front. With the guide member 30 attached to the board holding member 21, the wall-like portion 31 covers the front surface of the board holding member 21 and the connecting edge portion 24 penetrates through the through groove 35. The side frame portions 32 cover both left and right side edges of the connecting edge portion 24 and the front frame portion 33 covers the front end edge of the connecting edge portion 24. Further, the protrusions 34 are fitted into mounting grooves 22 formed on both left and right side surfaces of the board holding member 21, and the guide member 30 is held in a state attached to the board holding member 21 by a known locking structure formed by the protrusions 34 and the mounting grooves 22.

The upper surfaces of the side frame portions 32 and that of the front frame portion 33 are continuous and flush with each other, and the lower surfaces of the side frame portions 32 and that of the front frame portion 33 are continuous and flush with each other. The upper edge of an opening of the through groove 35 is located at the same height as or slightly lower than the upper surfaces of the side frame portions 32 and the front frame portion 33. The lower edge of the opening of the through groove 35 is located at the same height as or slightly higher than the lower surfaces of the side frame portions 32 and the front frame portion 33. The upper surfaces of the side frame portions 32 and the front frame portion 33 are located at the same height as or slightly higher than that of the connecting edge portion 24, and the lower surfaces of the side frame portions 32 and the front frame portion 33 are located at the same height as or slightly lower than that of the connecting edge portion 24.

The front frame portion 33 is formed with a pair of vertically symmetrical guide slopes 36. The guide slopes 36 are arranged on the front end edge of the front frame portion 33, i.e. before the board contact portions 25 in the inserting direction of the circuit board 23 into the board accommodation space 16. The guide slope 36 on an upper surface side is inclined downwardly in the inserting direction into the board accommodation space 16, and the guide slope 36 on a lower surface side is inclined upwardly in the inserting direction into the board accommodation space 16. That is, a vertical distance between the upper and lower guide slopes 36 is gradually reduced toward a front side in the inserting direction. Further, the guide slopes 36 are formed over the entire width of the front frame portion 33.

The second housing 20 is fitted into the tubular fitting portion 13 from front of the first housing 10. With the second housing 20 fitted in the tubular fitting portion 13, the connecting edge portion 24 of the circuit board 23 is inserted in the board accommodation space 16. With the connecting edge portion 24 inserted in the board accommodation space 16, the resilient contact portions 18 arranged to vertically sandwich the connecting edge portion 24 resiliently come into contact with the board contact portions 25 of the connecting edge portion 24. In this way, the terminal fittings 17 of the first housing 10 and the circuit board 23 of the second housing 20 are conductively connected.

The card edge connector A of this first embodiment includes the first housing 10 formed with the board accommodation space 16 open forward, the terminal fittings 17 provided in the first housing 10 and formed with the resilient contact portions 18 projecting toward the board accommodation space 16, and the second housing 20 including the circuit board 23 to be inserted into the board accommodation space 16 from front of the first housing 10. In a state where the circuit board 23 is not inserted in the board accommodation space 16 and the resilient contact portions 18 are not resiliently deflected, a minimum interval (minimum facing distance) between the resilient contact portions 18 vertically facing each other in the board accommodation space 16 is set smaller than a plate thickness (vertical dimension) of the connecting edge portion 24. By this dimensional difference, the resilient contact portions 18 come into contact with the connecting edge portion 24 while being resiliently deflected to ensure a predetermined contact pressure when the connecting edge portion 24 is inserted into the board accommodation space 16.

Making the minimum facing distance between the resilient contact portions 18 and the plate thickness of the circuit board 23 (connecting edge portion 24) different means that the corner edge part on the leading end in the inserting direction of the connecting edge portion 24 butts against the resilient contact portions 18 and are strongly abraded against the resilient contact portions 18 in the process of inserting the circuit board 23 into the board accommodation space 16. Such butting and abrasion cause improper deformation of the resilient contact portions 18, plating peeling on contact portions of the resilient contact portions 18, the jamming of shaving from a part of the corner edge part of the connecting edge portion 24 between the resilient contact portions 18 and the circuit board 23. Such events cause a contact failure between the resilient contact portions 18 and the board contact portions 25 of the circuit board 23.

As a countermeasure against that, the card edge connector A of this first embodiment is provided with the guide slopes 36 to cover the leading edge of the circuit board 23 (front end edge of the connecting edge portion 24) in the inserting direction into the board accommodation space 16. The guide slopes 36 are made of a synthetic resin material softer than the circuit board 23 (connecting edge portion 24) or a synthetic resin material having a lower rigidity than the circuit board 23 (connecting edge portion 24) to protect contacts. For example, if the circuit board 23 is a glass epoxy board, the guide slopes 36 can be made of synthetic resin containing no glass fiber. The guide slopes 36 are inclined with respect to the inserting direction into the board accommodation space 16. Thus, in the process of inserting the connecting edge portion 24 into the board accommodation space 16, the resilient contact portions 18 are gradually resiliently deflected while sliding in contact with the tapered guide slopes 36 without contacting the corner edge part on the front end of the connecting edge portion 24.

As just described, in the card edge connector A of this first embodiment, the butting of the connecting edge portion on the leading end in the inserting direction of the circuit board 23 against the resilient contact portions 18 and strong abrasion of this connecting edge portion against the resilient contact portions 18 are avoided in the process of inserting the circuit board 23 into the board accommodation space 16. That is, in the inserting process of the circuit board 23, events that cause a reduction of contact reliability do not occur on the resilient contact portions 18 and the circuit board 23. Thus, according to the card edge connector A of this first embodiment, a contact failure between the resilient contact portions 18 and the circuit board 23 can be prevented.

Further, the second housing 20 includes the board holding member 21 made of synthetic resin and configured to surround areas of the circuit board 23 except the leading end part (connecting edge portion 24) in the inserting direction, and the guide slopes 36 are formed on the component (guide member 30) separate from the board holding member 21. According to this configuration, the material of the guide slopes 36 can be selected regardless of the board holding member 21. Further, the guide slopes 36 may be made of a synthetic resin material containing no glass fiber. According to this configuration, coatings of the resilient contact portions 18 can be prevented from being scraped unlike in the case of using a synthetic resin containing glass fibers.

Figure 7:
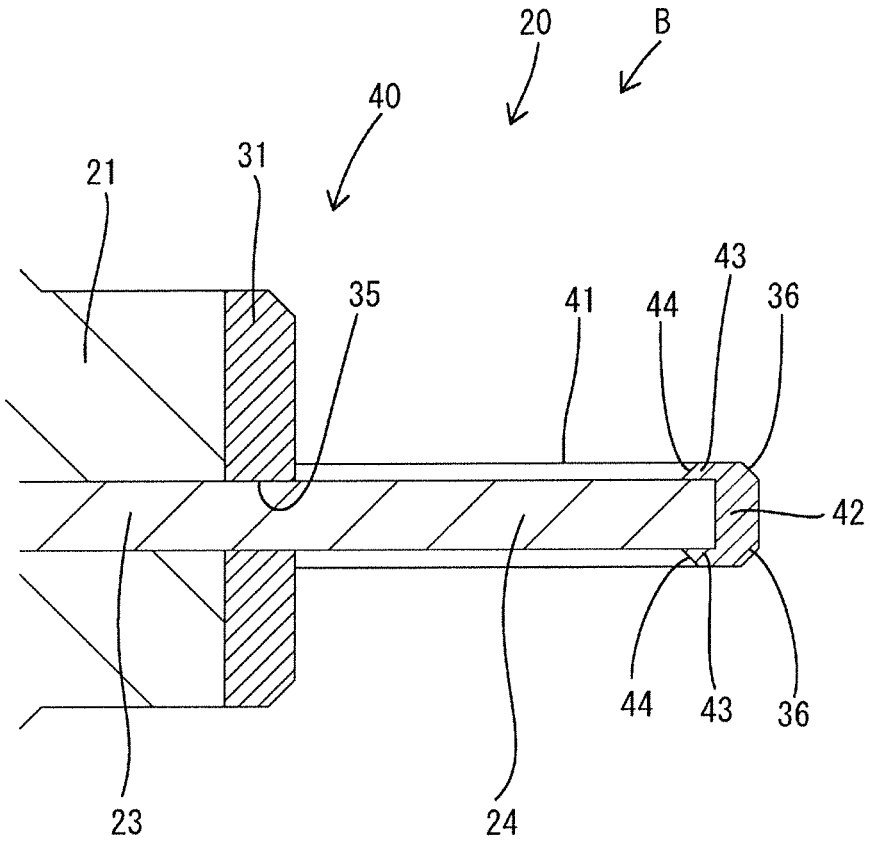
FIG. 7 is a partial enlarged section of a second housing in a card edge connector of a second embodiment.

Next, a second embodiment of the invention is described with reference to FIG. 7. In a card edge connector B of this second embodiment, a guide member 40 differs in configuration from the guide member 30 of the above first embodiment. Since the other components are the same as in the above first embodiment, they are denoted by the same reference signs and structures, functions and effects thereof are not described.

The guide member 40 of this second embodiment and the guide member 30 of the first embodiment differ only in the configurations of side frame portions 41 and a front frame portion 42. Specifically, in the guide member 30 of the first embodiment, the upper surfaces of the side frame portions 32 and the front frame portion 33 are located substantially at the same height as that of the connecting edge portion 24, and the lower surfaces of the side frame portions 32 and the front frame portion 33 are located substantially at the same height as that of the connecting edge portion 24. In contrast, in the guide member 40 of this second embodiment, the upper surfaces of the side frame portions 41 and the front frame portion 42 are set higher so that a clear step is formed between the upper surfaces of the side frame portions 41 and the front frame portion 42 and that of a connecting edge portion 24. Further, the lower surfaces of the side frame portions 41 and the front frame portion 42 are set lower so that a clear step is formed between the lower surfaces of the side frame portions 41 and the front frame portion 42 and that of the connecting edge portion 24.

Further, the front frame portion 42 is formed with a covering portion 43 for covering the front end edge on the upper surface of the connecting edge portion 24 and a covering portion 43 for covering the front end edge on the lower surface of the connecting edge portion 24. The upper surface of the upper covering portion 43 is continuous and flush with that of the front frame portion 42, and the lower surface of the lower covering portion 43 is continuous and flush with that of the front frame portion 42. A guiding slope 44 inclined with respect to an inserting direction of a circuit board 23 is formed on a rear edge part of the upper covering portion 43. This upper guiding slope 44 is inclined downwardly toward a rear side in the inserting direction conversely to an upper guide slope 36. Further, a guiding slope 44 inclined with respect to the inserting direction of the circuit board 23 is also formed on a rear edge part of the lower covering portion 43. This lower guiding slope 44 is inclined upwardly toward the rear side in the inserting direction conversely to a lower guide slope 36.

According to the card edge connector B of this second embodiment, since a pair of upper and lower covering portions 43 sandwich the front end edge of the connecting edge portion 24 in a plate thickness direction (vertical direction), a displacement of the front frame portion 42 (guide slope 36) in the plate thickness direction with respect to the connecting edge portion 24 can be prevented. Further, the steps are formed between the front frame portion 42 and the connecting edge portion 24 by forming the covering portions 43. In view of this point, the guiding surfaces 44 are formed on the rear edge part of the covering portions 43. Since this causes resilient contact portions 18 to slide in contact with the guiding slopes 44 in the process of pulling out the circuit board 23 from the board accommodation space 16, the resilient contact portions 18 neither strongly butt against nor are abraded against the covering portions 43. Thus, plating peeling, improper deformation and the like of the resilient contact portions 18 do not occur also in pulling out the circuit board 23.

Figure 8:
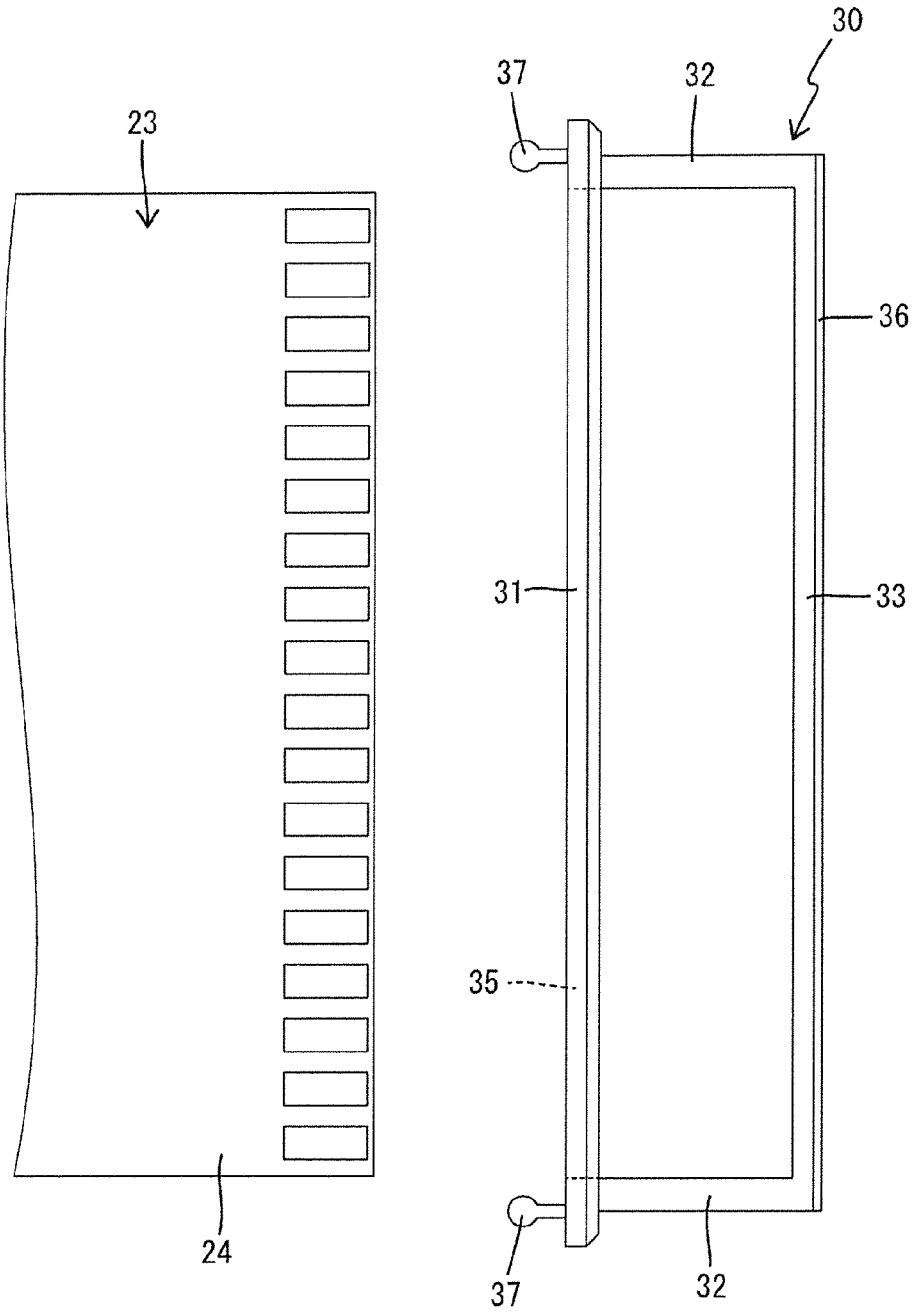
FIG. 8 is a plan view showing a state before a guide member is attached to a circuit board in a card edge connector of a third embodiment.
Figure 9:
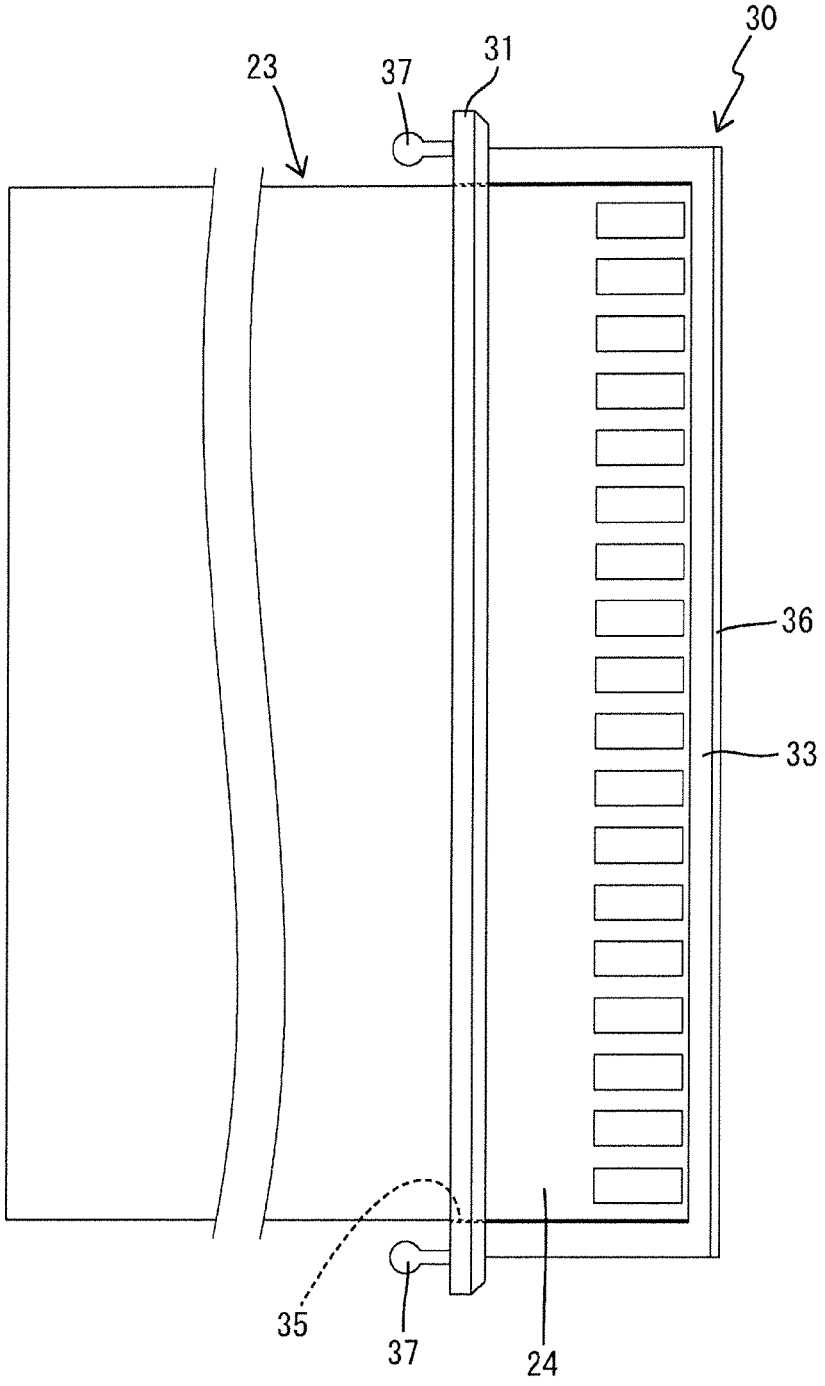
FIG. 9 is a plan view showing a state where the guide member is attached to the circuit board.
Figure 10:
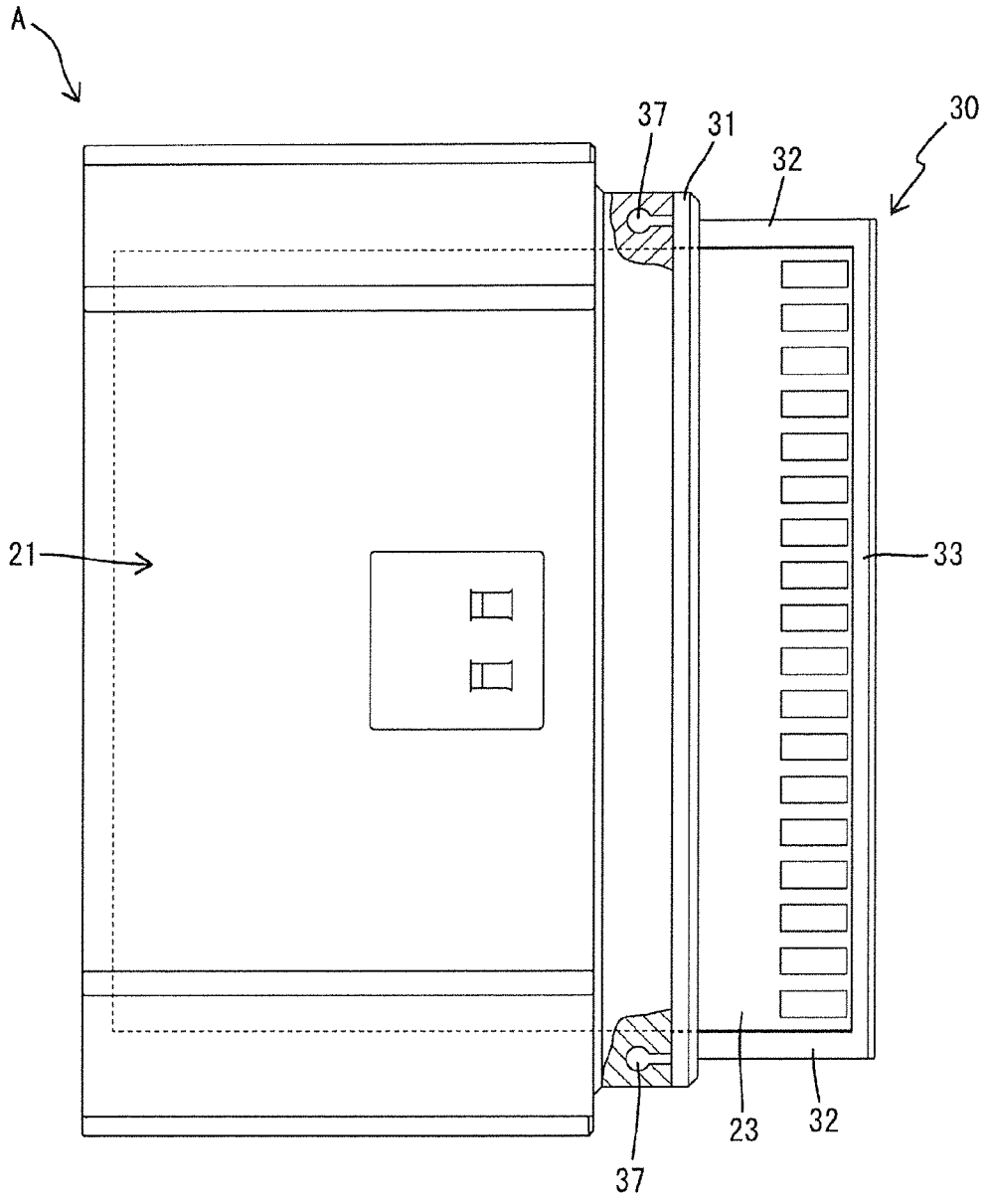
FIG. 10 is a plan view partly in section of a second housing.

FIGS. 8 to 10 show a card edge connector A according to a third embodiment of the present invention.

In the first and second embodiments, the board holding member 21 is molded with the circuit board 23 inserted and, thereafter, the guide member 30 is attached. However, in this third embodiment, a guide member 30 is attached to a circuit board 23 in advance and a board holding member 21 is molded with that assembly inserted. The configuration of the guide member 30 according to this third embodiment is basically the same as the guide member 30 of the first embodiment.

FIG. 8 shows an operation status in attaching the guide member 30 to a connecting edge portion of the circuit board 23. As shown in FIG. 8, the guide member 30 includes a wall-like portion 31 having a through groove 35, a pair of side frame portions 32 extending forward from both left and right end parts of the front surface of the wall-like portion 31 and a front frame portion 33 coupling extending end edges of the both side frame portions 32 and having a pair of upper and lower guide slopes 36. Further, a pair of retaining projections 37 are formed to project on both left and right end parts of the rear surface of the wall-like portion 31.

In manufacturing the card edge connector A, the guide member 30 is first attached to the circuit board 23. In that case, the guide member 30 has the connecting edge portion 24 of the circuit board 23 inserted into the through groove 35 of the wall-like portion 31. With the guide member 30 properly attached to the circuit board 23, the front frame portion 33 is held in close contact along the leading edge of the circuit board 23 and the both side frame portions 32 are held in close contact along both left and right side edges of the circuit board 23.

An assembly obtained by attaching the guide member 30 to the circuit board 23 in this way is set in a mold (not shown) for molding the board holding member 21 and molten resin is filled into a mold interior in that state. A cut-off groove (not shown) for the mold is formed by recessing the wall-like portion 31 over the entire peripheral edge, and the circuit board 23 and the guide member 30 located before the cut-off groove are exposed outside the mold and a part behind the cut-off groove including the both retaining projections 37 is accommodated in the mold when the mold is closed with the cut-off groove as a boundary.

A second housing 20 taken out after insert molding is completed in this way is molded such that a rear half of the circuit board 23 is embedded together with the both retaining projections in the board holding member 21. That is, since the guide member 30 is united with the board holding member 21 while being attached to the circuit board 23 by coupling the both retaining projections 37 and a rear half of the wall-like portion 31 in the guide member 30 to the board holding member 21, the guide member 30 is firmly held so as not to be detached from the circuit board 23 and a holding force is increased.

Figure 11:
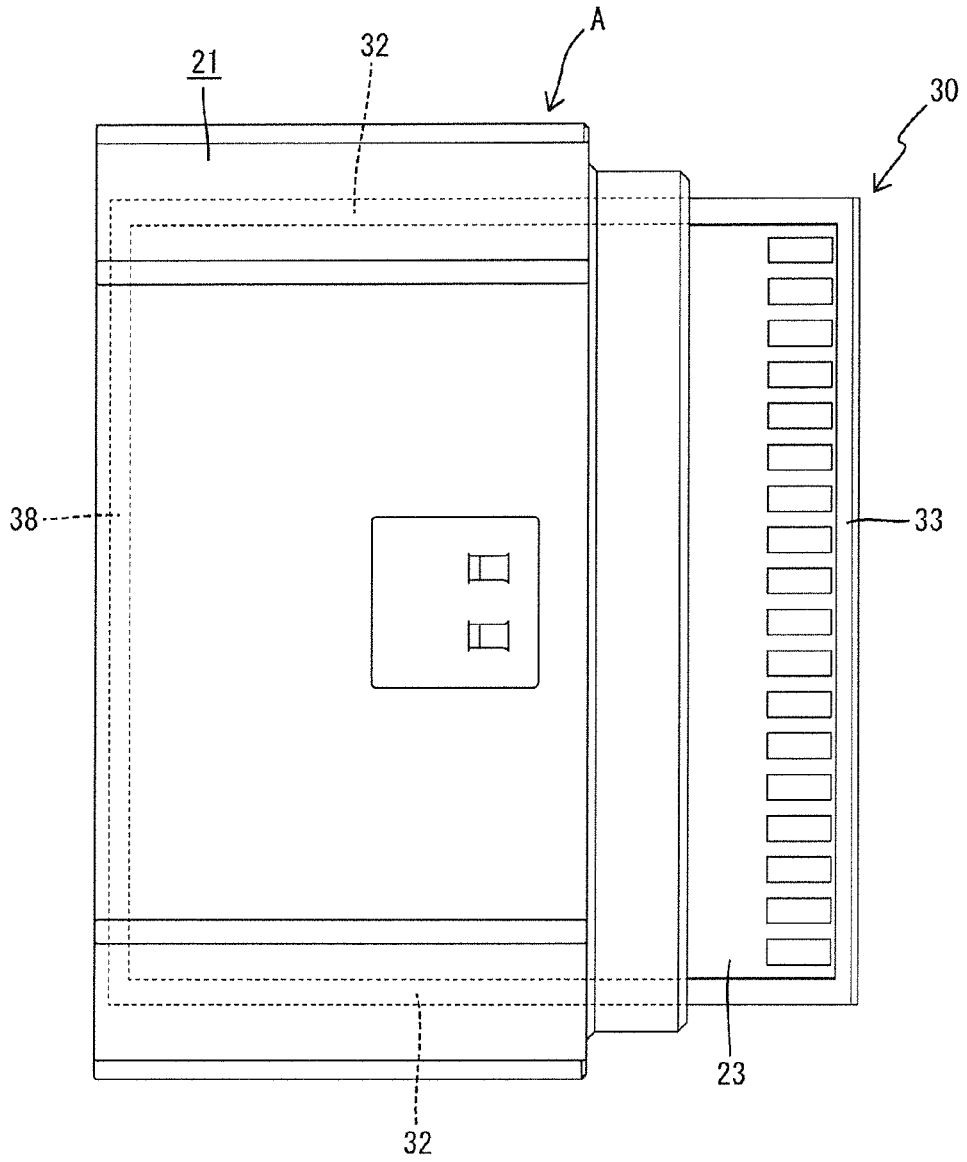
FIG. 11 is a plan view showing a second housing in a card edge connector of a fourth embodiment.

FIG. 11 shows a card edge connector A according to a fourth embodiment of the present invention. In this fourth embodiment, the procedure of manufacturing a second housing 20 is similar to that of manufacturing the second housing 20 of the third embodiment, and the fourth embodiment differs only in the shape of a guide member 30.

In this fourth embodiment, the guide member 30 is made of synthetic resin and formed into a substantially rectangular frame fittable along the outer peripheral surface of the circuit board 23. That is, the guide member 30 is composed of a front frame portion 33, a pair of side frame portions 32 and a rear frame portion 38 extending along the rear edge of a circuit board 23, but does not include the wall-like portion 31 and the retaining projections 37 unlike in the third embodiment.

In this fourth embodiment, the guide member 30 is embedded in a board holding member 21 except a front area (area indicated by dotted line in FIG. 11 is an embedded part) as shown in FIG. 11 in a state where the board holding member 21 is molded. Thus, the guide member 30 is firmly held so as not to be detached from the circuit board 23 and a holding force is increased as in the third embodiment.

The invention is not limited to the above described and illustrated embodiments. For example, the following embodiments are also included in the scope of the invention.

Although the terminal fittings are provided to face each other across the circuit board (board accommodation space) in the above first and second embodiment, the terminal fittings may be arranged on one side to face only one of the both sides of the circuit board.

Although the guide slopes and the board holding member are made of different materials in the above first and second embodiments, the guide slopes and the board holding member may be made of the same material.

Although the component (guide member) formed with the guide slopes is separate from the board holding member in the above first and second embodiments, the guide slopes may be integrally formed on the board holding member.

Although the guide slopes are made of the synthetic resin containing no glass fiber in the above first and second embodiments, the guide slopes may be made of synthetic resin containing glass fibers.

In the third embodiment, the guide member includes the wall-like portion as in the first embodiment. However, the guide member may not include the wall-like portion.

Although the guide member is formed with the retaining projections and the guide member and the board holding member are physically coupled in the third embodiment, the retaining projections can be omitted. In that case, if the board holding member and the guide member are made of the same resin material, good adhesion is obtained on interfaces of the board holding member and the guide member, which is effective in ensuring a guide member holding force.

Although the guide member is continuous over the entire circumference in the above embodiment, the guide member may be, for example, divided into two pieces that can be united.

LIST OF REFERENCE SIGNS

A . . . card edge connector
10 . . . first housing
16 . . . board accommodation space
17 . . . terminal fitting
18 . . . resilient contact portion
20 . . . second housing
21 . . . board holding member
23 . . . circuit board
31 . . . wall-like portion (part to be embedded in board holding member)
36 . . . guide slope
37 . . . retaining projection (part to be embedded in board holding member)
B . . . card edge connector
40 . . . guide member
43 . . . covering portion
44 . . . guiding slope

The invention claimed is:

1. A card edge connector, comprising:

a first housing formed with a board accommodation space open forward, a terminal fitting provided in the first housing and formed with a resilient contact portion projecting toward the board accommodation space; and a second housing including a circuit board to be inserted into the board accommodation space from front of the first housing;

the second housing including a board holding member made of a first synthetic resin and configured to surround an area of the circuit board except a leading end part in an inserting direction and a guide member formed from a second synthetic resin that is different than the first synthetic resin and less rigid than the first synthetic resin, the guide member having a pair of left and right side frame portions arranged before a front surface of the board holding member and a front frame portion coupling front ends of the side frame portions; and the front frame portion including a guide slope provided to cover a leading edge of the circuit board in the inserting direction into the board accommodation space and inclined with respect to the inserting direction into the board accommodation space.

2. A card edge connector, comprising:

a first housing formed with a board accommodation space open forward, a terminal fitting provided in the first housing and formed with a resilient contact portion projecting toward the board accommodation space; and a second housing including a circuit board to be inserted into the board accommodation space from front of the first housing;

the second housing including a board holding member made of synthetic resin and configured to surround an area of the circuit board except a leading end part in an inserting direction and a guide member having a pair of left and right side frame portions, the pair of side frame portions extending along both left and right side edges of the circuit board and a front frame portion coupling front ends of the side frame portions, the front frame portion extending along the leading edge of the circuit board, the front frame portion including a guide slope provided to cover a leading edge of the circuit board in the inserting direction into the board accommodation space and inclined with respect to the inserting direction into the board accommodation space; and the guide member further including a rear frame portion extending along a rear edge of the circuit board.

3. The card edge connector of claim 2, wherein the guide member is a component separate from the board holding member.

4. The card edge connector of claim 3, wherein the guide slope is formed of a synthetic resin material containing no glass fiber.

5. The card edge connector of claim 4, wherein the guide member is formed with a pair of covering portions configured to sandwich a leading edge part in the inserting direction of the circuit board in a plate thickness direction.

6. The card edge connector of claim 5, wherein the covering portion is formed with a guiding slope inclined with respect to the inserting direction of the circuit board.

7. The card edge connector of claim 6, wherein a part of the guide member except a leading end part in the inserting direction is embedded in the board holding member.

8. The card edge connector of claim 1, wherein the guide slope is formed of a synthetic resin material containing no glass fiber.

9. The card edge connector of claim 1, wherein the guide member is formed with a pair of covering portions configured to sandwich a leading edge part in the inserting direction of the circuit board in a plate thickness direction.

10. The card edge connector of claim 1, wherein the covering portion is formed with a guiding slope inclined with respect to the inserting direction of the circuit board.

11. The card edge connector of claim 1, wherein a part of the guide member except a leading end part in the inserting direction is embedded in the board holding member.

* * * * *